United States Patent [19]

Killinger

[11] Patent Number: 4,625,924

[45] Date of Patent: Dec. 2, 1986

[54] HOLD DOWN MECHANISM FOR REDUCTION APPARATUS

[75] Inventor: Glenn W. Killinger, Fountain Inn, S.C.

[73] Assignee: Dresser Industries, Inc., Dallas, Tex.

[21] Appl. No.: 770,026

[22] Filed: Aug. 27, 1985

[51] Int. Cl.[4] ..... B02C 13/286; B02C 23/02

[52] U.S. Cl. ..... 241/186 R; 198/626; 241/189 R; 241/223

[58] Field of Search ..... 241/186 R, 189 R, 280, 241/223, 186.4; 198/620, 626, 627, 628; 100/154, 901

[56] References Cited

U.S. PATENT DOCUMENTS 2,150,984 3/1939 Near et al. .
3,825,192 7/1974 Knight .

*Primary Examiner*—Mark Rosenbaum
*Attorney, Agent, or Firm*—Fred A. Winans

[57] ABSTRACT

The hold down device is pivotal toward and away from a feeding table which conveys various sizes of materials to reduction apparatus. The hold down device includes a curved belly pan which, depending upon its point of contact with the material, creates either an additional hold down force to aid in conveying and shredding the material or creates a force raising the hold down device to avoid jamming.

7 Claims, 5 Drawing Figures

HOLD DOWN MECHANISM FOR REDUCTION APPARATUS

FIELD OF THE INVENTION

This invention relates generally to reduction apparatus for shredding materials. More specifically, but not by way of limitation, this invention relates to an improved hold down mechanism for use in reduction apparatus.

BACKGROUND OF THE INVENTION

There are many applications of materials reduction apparatus in which the materials are reduced in size for further use of the reduced product, or for further processing, or for disposal of the product, in the latter instance the materials being waste materials. Customarily, the materials need to be fed into the reduction apparatus in a controlled or regulated manner, so as not to overload the reduction apparatus, which could result in stalling and damage of the equipment.

With the growing awareness of the need to dispose of waste materials in such manner as does not pollute the environment, attention has been given to the use of reduction apparatus for reducing the waste materials to a small product size, in order to facilitate disposal of the materials as by incineration, landfill and other methods. Typical of such waste materials are rolls of paper, loose paper, cardboard from various sources, particularly including containers, a variety of plastics, wood pallets, scrap wood, and the like. These materials occur in great quantities and, in their ordinary form, have considerable bulk which is disproportionately large to the actual mass of the materials themselves. This causes difficulty in handling the materials, unless they are reduced to a small product size, which of itself substantially increases the density of the mass of material and facilitates handling the same for ultimate disposition, whether it be by incineration, land-fill operation, dumping or other methods of disposal.

U.S. Pat. No. 2,150,984 issued Mar. 21, 1939 to L. B. Near et al, illustrates reduction apparatus which has been designed for the purpose of shredding junked items such as automobile bodies. In that patent, the apparatus includes a horizontal feeding table and a crushing device located above the table to exert a downwardly directed crushing force on the material.

U.S. Pat. No. 3,825,192 issued July 23, 1974 to Lloyd K. Knight, illustrates reduction apparatus including a hold down device similar to the apparatus of this invention. The apparatus described in this invention is an improvement to the apparatus described in the Knight patent.

The hold down device of Knight has performed generally satisfactorily. However, problems have been encountered when randomly sized materials are placed on the feeding table for delivery to the reduction apparatus. Large size materials engaging the hold down device sometimes cause the hold down device to stall, interrupting the operation of the reduction apparatus.

An object of this invention is to provide an improved hold down mechanism for reduction apparatus that efficiently handles the various sizes of waste material being fed to the reducer.

SUMMARY OF THE INVENTION

This invention provides an improved hold down device for use in conveying materials to reduction apparatus. The hold down device includes a frame located above a feeding table and pivotally mounted with respect to the table. The frame includes a curved belly pan or plate located on the side of the frame adjacent to the table. The belly pan has a convex portion projecting toward the table, an end adjacent to the reduction apparatus, and a remote end. An endless chain, having material engaging members mounted thereon, is located on the frame and passes between the belly pan and the table. The pivot axis of the frame is located in relation to the curved belly pan whereby reaction force vectors caused by the engagement between the material and the hold down device either causes the hold down device to pivot upwardly or increases the hold down force exerted on the material by the hold down device.

BRIEF DESCRIPTION OF THE DRAWING

The foregoing and additional objects and advantages of the invention will become more apparent as the following detailed description is read in conjunction with the accompanying drawing wherein like reference characters denote like parts in all views and wherein.

DESCRIPTION OF THE PREFERRED EMBODIMENT

Figure 1:
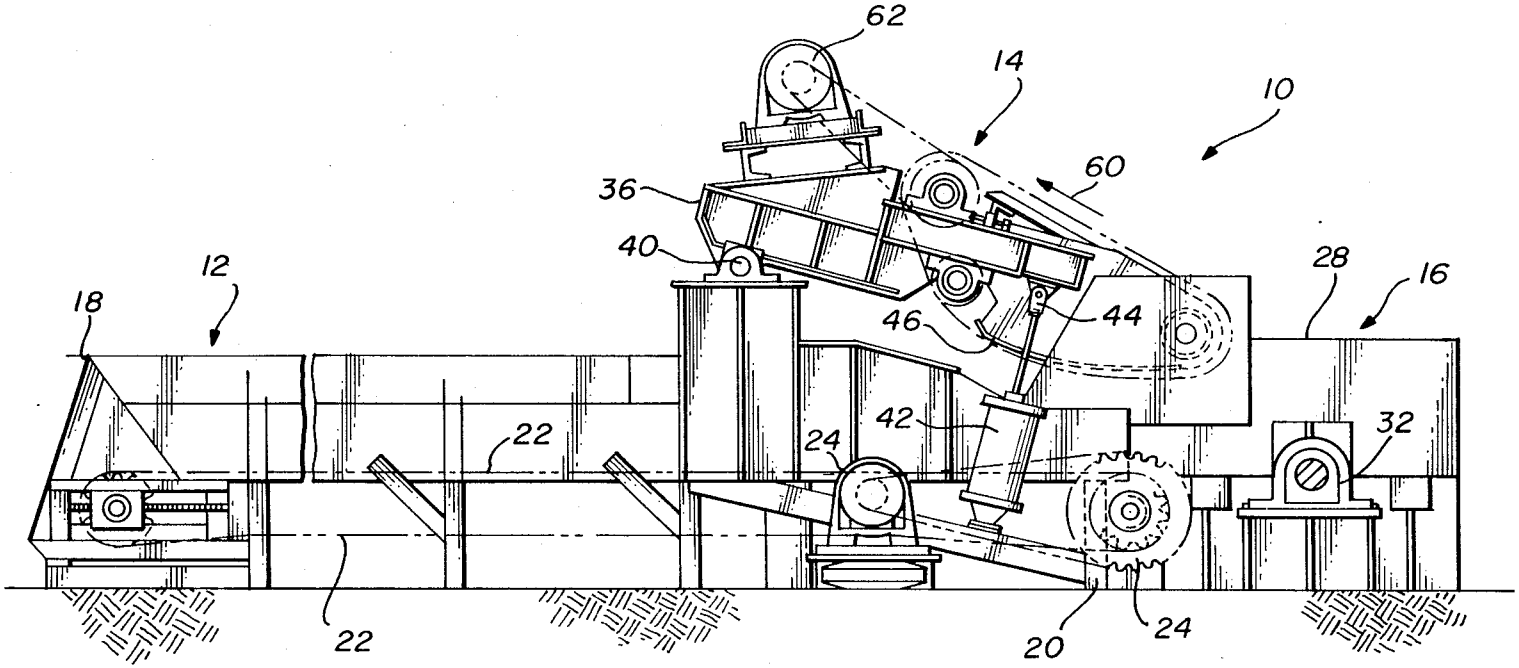
FIG. 1 is a side elevation view of reduction apparatus that includes a hold down device that is constructed in accordance with the invention.
Figure 2:
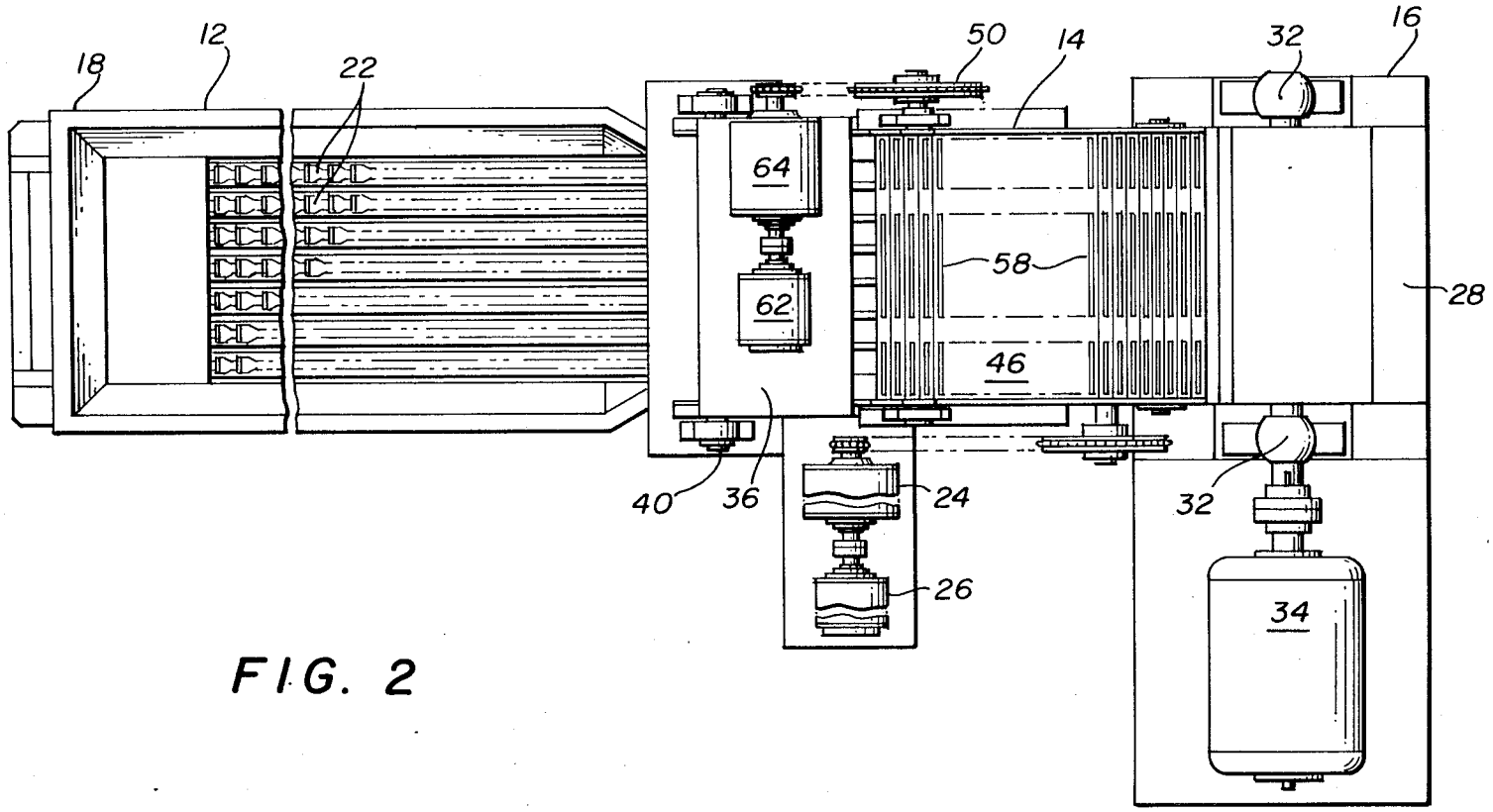
FIG. 2 is a top plan view of the apparatus of FIG. 1.

Referring to the drawing and to FIGS. 1 and 2 in particular, shown therein and generally designated by the reference character 10 is reduction apparatus that includes a generally horizontally disposed feeding table 12, a hold down assembly 14 located above the table 12, and a shredding device 16.

The feeding table 12 includes a remote end 18 and a second end 20 (see FIG. 3) that is disposed adjacent to the shredding device 16. The table 12 also includes a plurality of chains 22 which extend in side-by-side relationship from the remote end 18 of the table 12 to the second end 20. The chains 22 are provided for the purpose of moving material that is to be shredded along the table 12 and into the shredding device 16. The chains 22 are driven through a speed reducer 24 by a suitable drive, such as a hydraulic or electric motor 26.

The shredding device 16 includes a housing 28 that encompasses a plurality of shredding blades 30 (see FIG. 3) that are rotatable in bearings 32 mounted on the housing 28. The blades 30 are driven by an electric motor 34 which is shown in FIG. 2. The construction of the shredding device is well known in the art and will not be described further.

The hold down device 14 includes a frame 36 that is pivotally connected to the frame of the reduction apparatus 10 by pivot pins 38 which extend transversely with respect to the length of the table 12 and form a pivot axis 40 about which the hold down device 14 pivots. Pivotal movement of the hold down device 14 may be effected by a pneumatic cylinder 42 that has one end connected to the frame of the reduction apparatus 10 and the opposite end connected to the hold down frame 36 by a clevis 44.

The frame 36 carries, on the side thereof adjacent to the surface of table 12, a curved belly pan or plate 46. The apex of the convex portion of the belly pan 46 is indicated by a center line that is designated by the reference character 48 (see FIG. 3). The belly pan 46 is a heavy, wear resistant, generally rectangular plate that is supported by the frame 36. Although not specifically illustrated, the pan 46 may be attached to the frame 36 so that it can be relatively easily removed when necessary.

The frame 36 journals drive sprockets 50, turning sprockets 52, and idler drums 54 which are located in appropriate positions to carry a plurality of endless chains 56. Although only one set of sprockets is shown, it will be understood that as many sets as needed may be located across the width of the hold down device 14. A set of sprockets consists of the drive sprocket 50, turning drum 52 and an idler drum 54. The chains 56 are disposed on the lower side of the hold down device 14 between the belly pan 46 and the conveyor chains 22 of the table 12. The belly pan 46 supports the chains 56 and the chains 56 will wear on the pan 46 eventually necessitating its replacement.

Figure 3:
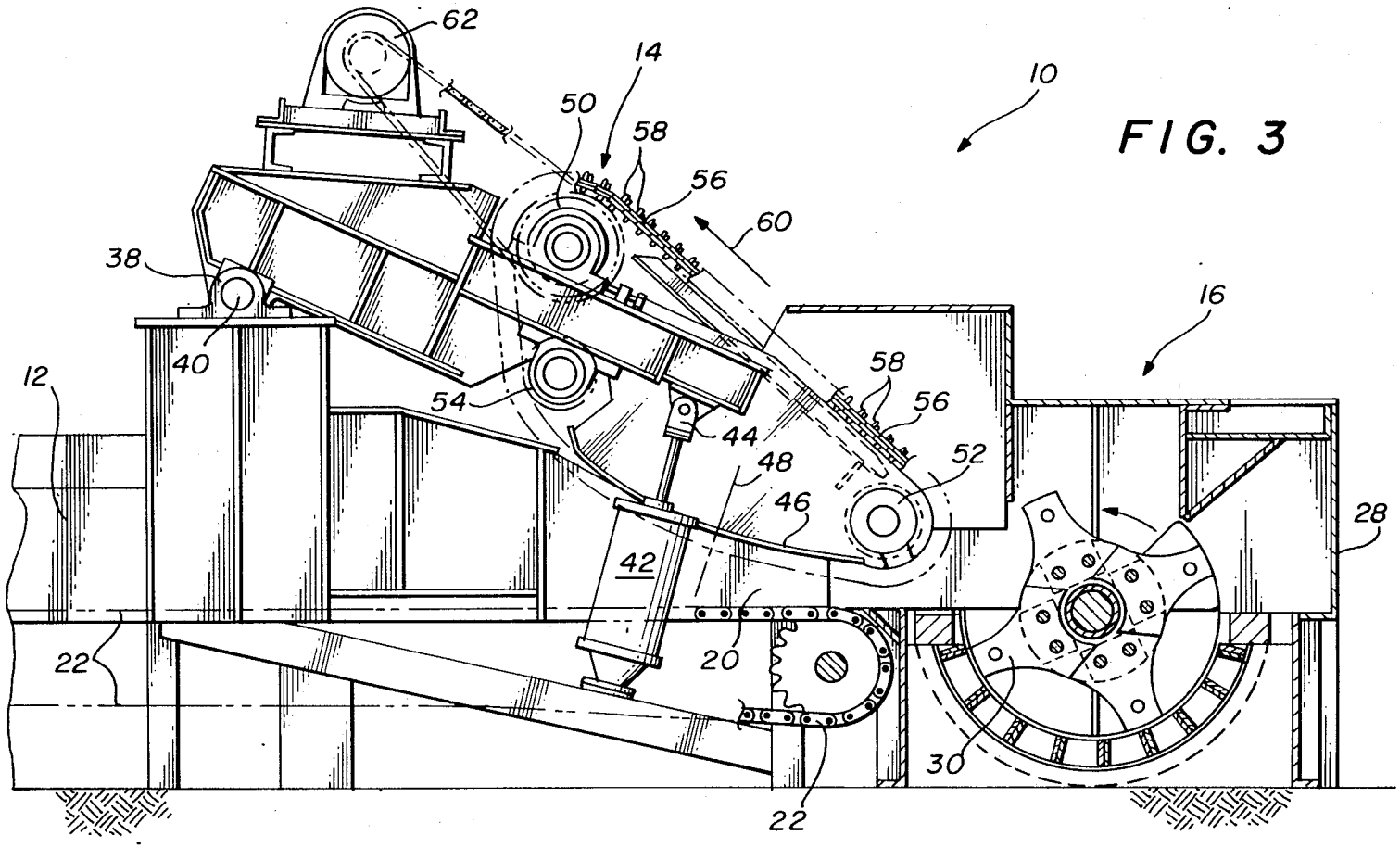
FIG. 3 is an enlarged, somewhat schematic view of a portion of the apparatus of FIG. 1 illustrating the hold down device in more detail.
Figure 4:
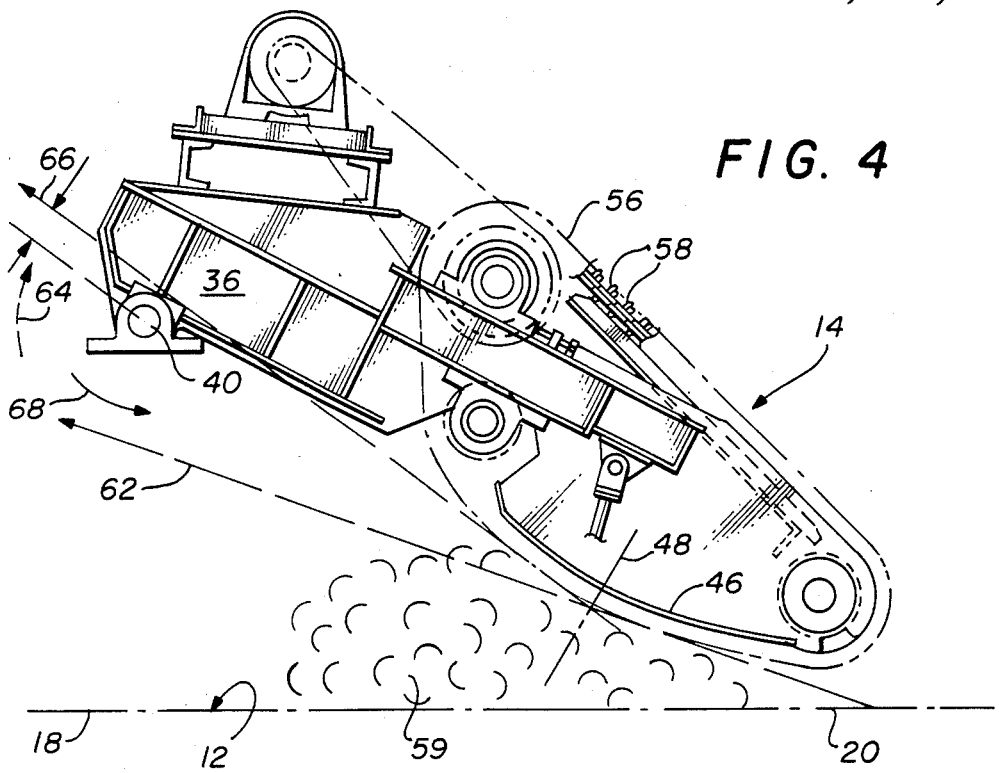
FIG. 4 is a schematic illustration showing the force vectors and the moment about the pivotal axis for the hold down device of FIG. 1 in one operating position.
Figure 5:
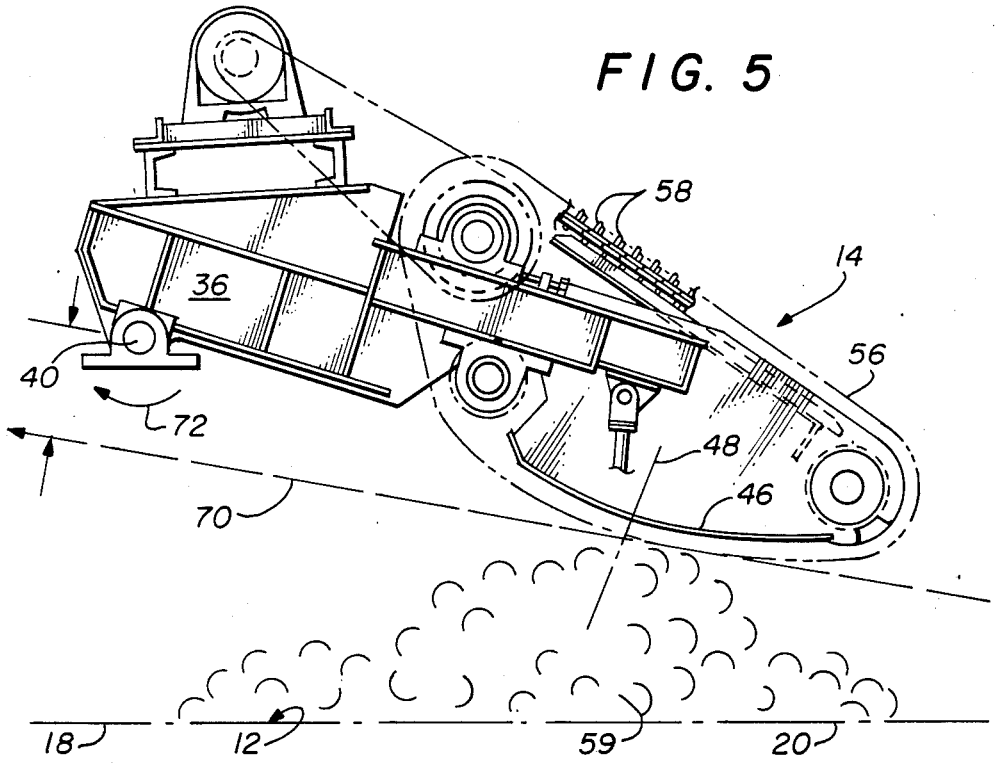
FIG. 5 is a schematic illustration similar to FIG. 4 showing the hold down device in another operating position.

As shown most clearly in FIGS. 2 and 3 a plurality of elongated material engaging members 58 extend transversely across the hold down device 14 and are attached to the chains 56. As can be seen in FIG. 3, the members 58 project outwardly from the chains 56 so that they will engage material 59 located on the table 12 as shown in FIGS. 4 and 5.

The chains 22 on the table 12 are driven in the appropriate direction to move material from the remote end 18 to the end 20 thereof. The chains 56 on the hold down device 15 are driven in the direction indicated by the arrow 60. To impart movement to the chains 56, an electric motor 62 is mounted on the frame 36 and, through a reduction drive 64, causes the drive sprocket 50 to rotate and drive the chains 56.

DESCRIPTION OF THE OPERATION

In general, the reduction apparatus 10 is arranged to receive the material 59 (see FIGS. 4 & 5) to be shredded at the remote end 18 of the table 12. The material 59 is moved by the chains 22 toward the end 20 of the table 12. If the material 59 is of a type that can be easily shredded, the hold down device 14 may be elevated by the cylinders 42 to the position illustrated in FIG. 1. With the hold down device 14 in this position, the material 59 is moved by the chains 22 into the shredding blades 30.

When the material is not of the type that can be easily shredded, the cylinder 42 is lowered to pivot the hold down device 14 to the position illustrated in FIG. 3. As the material 59 moves along the table 12 it encounters the material engaging members 58 carried by the hold down device 14.

If the material 59 is of a height so that is engages the hold down device 14 between the apex 48 of the curved belly pan 46 and the end 20 of the table 12, the hold down device 14 remains in the position illustrated in FIGS. 3 and 4. With thin material 59, additional forces tending to move the hold down device 14 toward the table 12 are generated. The reaction force vector 62 shown in dashed line in FIG. 4 is directed below the pivot axis 40, and thus generates a torque about the pivot axis 40 in the direction of the dash arrow 64 which results in a downward force on the hold down device 14.

In the event that the material 59 has sufficient height above the table 12 so that it encounters the hold down device 14 at a location on the belly pan 46 between the apex 48 and the remote end 18 of the table 12, the reaction force vector 66 extends above the pivot axis 40 and creates a torque about the pivot axis 40 in the direction of arrow 68. Torque in this direction tends to raise the hold down device 14 and prevents jamming of the hold down device 14 due to the height of the waste material 59.

When the high material 59 is encountered by the hold down device 14, the hold down device 14 pivots upwardly to the position illustrated in FIG. 5. When the contact of the material 59 has moved to a position between the apex 48 of the curved belly pan 46 and the end 20 of the table 12, the reaction force vector 70 extends below the pivot axis 40 and generates torque in the direction of the arrow 72 which again causes an additional force to be imposed on the device 14 tending to move the hold down device 14 toward the table 12.

Thus, a hold down device constructed in accordance with the invention provides apparatus suitable for use with the varying heights of materials that are to be shredded; apparatus that moves or pivots appropriately to prevent jamming; apparatus that aids in conveying the material toward the shredder; and apparatus that prevents the kick back of the material when it is engaged by the shredding blades.

Having described but a single embodiment of the invention, it will be understood that the foregoing detailed description is provided by way of example only and that many changes and modifications can be made thereto without departing from the spirit or scope of the annexed claims.

What is claimed is:

1. Feeding means for delivering a mass of materials into reduction apparatus, said feeding means comprising:

a generally horizontally disposed feeding table including material conveying means for moving material along said table toward said reduction apparatus, said table having a first end adjacent to said reduction apparatus and having a remote end;

hold down means located adjacent to the conveying means on said table, said hold down means including a frame carrying an endless traveling feed apparatus for moving said material toward said reduction apparatus and for engaging said material to hold said material to prevent movement of said material away from said reduction apparatus, and having a curved belly pan on the side thereof adjacent to the conveying means, said belly pan extending across the width of said feed apparatus and having a convex portion curved toward said table for supporting said feed apparatus in an arcuate configuration and for preventing deflection of said feed apparatus across the width thereof; and, pivot means supporting said hold down means for pivotal movement toward and away from said table, said pivot means including a pivot axis located relative to tangents to the curve of said belly pan whereby reaction force vectors are generated when said endless traveling feed apparatus engages the material on the convex portion between the apex thereof and the end adjacent to the first end of the frame for increasing downwardly directed forces applied by said hold down means to said material and when said feed apparatus engages the material on the convex portion between the apex and said remote end for causing said hold down means to pivot relatively away from said table.

2. Hold down means for use in conveying materials to reduction apparatus wherein said apparatus includes a feeding table, said hold down means comprising:

a frame having a first end adjacent to said reduction apparatus and a remote end, said frame being located adjacent to the feeding table;

a curved belly pan located on the side of said frame adjacent to said table extending across the width of said frame and having a convex portion curved toward the table;

endless feed apparatus operably located on said frame and passing between said belly pan and the table whereby said belly pan prevents deflection of said feed apparatus across the width thereof;

material engaging means mounted on said feed apparatus for moving said material in one direction and preventing movement of said material in the opposite direction; and, pivot means supporting frame and providing a generally horizontal pivot axis located relative to tangents to the curve of said belly pan whereby reaction force vectors are generated upon the engagement of said material engaging means with said material between the apex of said convex portion and the first end of the frame to increase the downwardly directed force exerted by said hold down means and upon the engagement of said material engaging means with said material between the apex of said convex portion and said remote end to cause said hold down means to pivot relatively away from the table.

3. The hold down means of claim 2 wherein the portion of said feed apparatus between the belly pan and the feeding table is moving in a direction to move material with said material engaging means along the table to said reduction apparatus.

4. The hold means of claim 3 wherein said feed apparatus includes:

a plurality of endless chains located in spaced, side-by-side relationship;

a plurality of sets of drums located to carry each said chain and positioned to guide said chains in a preselected path;

a set of chain sprockets engaging sid chains for driving said chains; and means for driving said sprockets.

5. The hold down means of claim 4 wherein said material engaging means includes a plurality of elongated members extending transversely with respect to said chains, each said member being connected to a plurality of said chains.

6. The hold down means of claim 5 and also including cylinder means extending between said frame and the table for positioning said frame at a preselected angle relative to the table.

7. An improved hold down means for use in conveying materials to reduction apparatus wherein said apparatus includes a feeding table, said improvement comprising:

a hold down frame supported on a pivot axis for pivotal movement relative to the table, said frame having a remote end and having a second end adjacent to the reduction apparatus;

a curved belly pan mounted on said frame between said frame and the table, said belly pan extending across the width of said frame and having a convex portion curving toward the table and having an apex;

material engaging means carried by the frame including a chain system partially disposed between said belly pan and the table and held in curved configuration and prevented from deflecting across the width thereof by said belly pan, tangents to said curved configuration between the apex and remote end extending relatively above said pivot axis and tangents to said curved configuration between the apex and second end extending relatively below said pivot axis whereby forces are generated to move said frame away from the table when engagement of the material occurs between the apex and remote end and forces are generated to move said frame toward the table when engagement of the material occurs between the apex and second end.

* * * * *